US010501695B2

(12) United States Patent
Morel et al.

(10) Patent No.: US 10,501,695 B2
(45) Date of Patent: Dec. 10, 2019

(54) PROCESS FOR THE INTENSE CONVERSION OF RESIDUES, MAXIMIZING THE GAS OIL YIELD

(71) Applicant: AXENS, Rueil Malmaison (FR)

(72) Inventors: Frederic Morel, Chatou (FR); Jacinthe Frecon, Rueil-Malmaison (FR)

(73) Assignee: AXENS, Rueil Malmaison (FR)

( * ) Notice: Subject to any disclaimer, the term of this patent is extended or adjusted under 35 U.S.C. 154(b) by 426 days.

(21) Appl. No.: 14/974,313

(22) Filed: Dec. 18, 2015

(65) Prior Publication Data

US 2016/0177202 A1 Jun. 23, 2016

(30) Foreign Application Priority Data

Dec. 18, 2014 (FR) ..... 14 62715

(51) Int. Cl.

| | |
|---|---|
| ***C10G 65/12*** | (2006.01) |
| ***C10G 67/04*** | (2006.01) |
| ***C10G 65/10*** | (2006.01) |
| ***C10G 67/00*** | (2006.01) |

(52) U.S. Cl.

CPC ..... *C10G 67/049* (2013.01); *C10G 65/10* (2013.01); *C10G 65/12* (2013.01); *C10G 67/00* (2013.01)

(58) Field of Classification Search

CPC ... C10G 65/12; C10G 67/0463; C10G 67/049
See application file for complete search history.

(56) References Cited

U.S. PATENT DOCUMENTS

| | | | | |
|---|---|---|---|---|
| 2,847,353 | A * | 8/1958 | Beavon | C10G 21/00 208/102 |
| 5,980,730 | A * | 11/1999 | Morel | C10G 69/04 208/100 |
| 7,704,377 | B2 | 4/2010 | Duddy et al. | |
| 7,919,054 | B2 | 4/2011 | Duddy et al. | |
| 2007/0209965 | A1 | 9/2007 | Duddy et al. | |
| 2008/0011643 | A1* | 1/2008 | Lenglet | C10G 67/00 208/58 |
| 2010/0166621 | A1 | 7/2010 | Duddy et al. | |
| 2013/0319908 | A1 | 12/2013 | Halais et al. | |

FOREIGN PATENT DOCUMENTS

| | | | |
|---|---|---|---|
| EP | 1840190 | A1 | 10/2007 |
| WO | 2012085407 | A1 | 6/2012 |

OTHER PUBLICATIONS

Search Report dated Oct. 12, 2015 issued in corresponding application FR 1462715 application (pp. 1-2).

* cited by examiner

*Primary Examiner* — Randy Boyer
(74) *Attorney, Agent, or Firm* — Millen, White, Zelano & Branigan, PC

(57) ABSTRACT

The invention concerns a process for the intense conversion of a heavy hydrocarbon feed, comprising the following steps: a) a first step for ebullated bed hydroconversion; b) a step for separating at least a portion of the hydroconverted liquid effluent obtained from step a); c) a step for hydrocracking at least a portion of the vacuum gas oil fraction obtained from step b); d) a step for fractionating at least a portion of the effluent obtained from step c); e) a step for recycling at least a portion of the unconverted vacuum gas oil fraction obtained from step d) to said first hydroconversion step a).

8 Claims, 4 Drawing Sheets

PROCESS FOR THE INTENSE CONVERSION OF RESIDUES, MAXIMIZING THE GAS OIL YIELD

The invention relates to the field of the production of gas oil starting from oil residues.

The concatenation of conversion and hydrocracking units in the treatment of oil residue feeds is known in the prior art.

U.S. Pat. Nos. 5,980,730 and 6,017,441 describe a process for the intense conversion of a heavy oil fraction, said process comprising a step for hydroconversion in a three-phase ebullated bed, an atmospheric distillation of the effluent obtained, a vacuum distillation of the atmospheric residue obtained after this distillation, a deasphalting step for the vacuum residue obtained and a hydrotreatment of the deasphalted fraction mixed with the distillate obtained during the vacuum distillation. It is also possible in that process to send at least a fraction of the hydrotreated effluent to a catalytic cracking section or to recycle a fraction of the effluent obtained from deasphalting or, in another variation a fraction of the asphalt, to the first hydroconversion step or indeed to send a heavy liquid fraction obtained from the hydrotreatment step to a fluidized bed catalytic cracking section.

U.S. Pat. No. 6,620,311 describes a conversion process which can be used to increase the yield of middle distillates. That process comprises a step for three-phase ebullated bed conversion, sending the effluent obtained to a separation section in order to produce an overhead distillate comprising a gas, gasoline and gas oil and from the bottom, essentially hydrocarbons with a boiling point which is higher than an atmospheric gas oil. The distillate is then treated in a hydrodesulphurization unit and the bottom fraction is treated in a catalytic cracking section in the absence of hydrogen, for example of the fluidized bed cracking type. That type of cracking thus differs from a hydrocracking step operated in fixed bed mode and in the presence of hydrogen.

U.S. Pat. No. 7,919,054 describes a facility for the treatment of heavy oil feeds comprising an ebullated bed hydroconversion section, a separation and a section for fixed bed hydrotreatment of the distillate obtained in the presence of hydrogen. That hydrotreatment may be a mild hydrocracking (4.5 to 16 MPa) or more severe hydrocracking (7 to 20 MPa).

However, the processes proposed in the prior art suffer from a limitation in the gas oil production yield. In fact, those processes produce a relatively large purge quantity of vacuum distillates from the bottom of the column of the units for vacuum separation of the hydroconversion effluents. Those fractions are obtained from vacuum separations and so, because of their polycondensed structures, they are difficult to upgrade as an oil base, compared with vacuum distillate fractions obtained from straight run distillation of oil cuts.

The Applicant proposes a novel process with a particular arrangement of the conversion units and optional deasphalting of the solvent in order to obtain higher yields of gas oil production than in the prior art processes, namely a yield of at least 55% by weight of the starting feed of vacuum residue.

Thus, one aim of the invention is to obtain intense conversion of the feed of oil residues while maximizing the gas oil production.

AIM OF THE INVENTION

The present invention concerns a process for the intense conversion of a heavy hydrocarbon feed, comprising the following steps:

a) a first step for ebullated bed hydroconversion of the feed in the presence of hydrogen, comprising at least one three-phase reactor containing at least one ebullated bed hydroconversion catalyst;

b) a step for separating at least a portion of the hydroconverted liquid effluent obtained from step a) into a fraction comprising a gasoline cut and a gas oil cut, a vacuum gas oil fraction and an unconverted residual fraction;

c) a step for hydrocracking at least a portion of the vacuum gas oil fraction obtained from step b) in a reactor comprising at least one fixed bed hydrocracking catalyst;

d) a step for fractionating at least a portion of the effluent obtained from step c) into a gasoline fraction, a gas oil fraction and an unconverted vacuum gas oil fraction;

e) a step for recycling at least a portion of the unconverted vacuum gas oil fraction obtained from step d) to said first hydroconversion step a).

The feed for the present invention is advantageously selected from heavy hydrocarbon feeds of the vacuum or atmospheric residue type obtained, for example, by straight run distillation of the oil cut or by vacuum distillation of crude oil, distillate type feeds such as vacuum gas oil or deasphalted oils, coal in suspension in a hydrocarbon fraction such as, for example, gas oil obtained by vacuum distillation (also known as vacuum distilled gas oil), crude oil, or a distillate obtained from coal liquefaction, used alone or as a mixture. The feed of the invention may contain vacuum residues such as Arabian Heavy vacuum residues, Ural vacuum residues and the like, vacuum residues obtained from Canadian or Venezuelan type heavy crudes, or a mixture of atmospheric residues or vacuum residues of diverse origins.

DETAILED DESCRIPTION OF THE INVENTION

Figure 1:
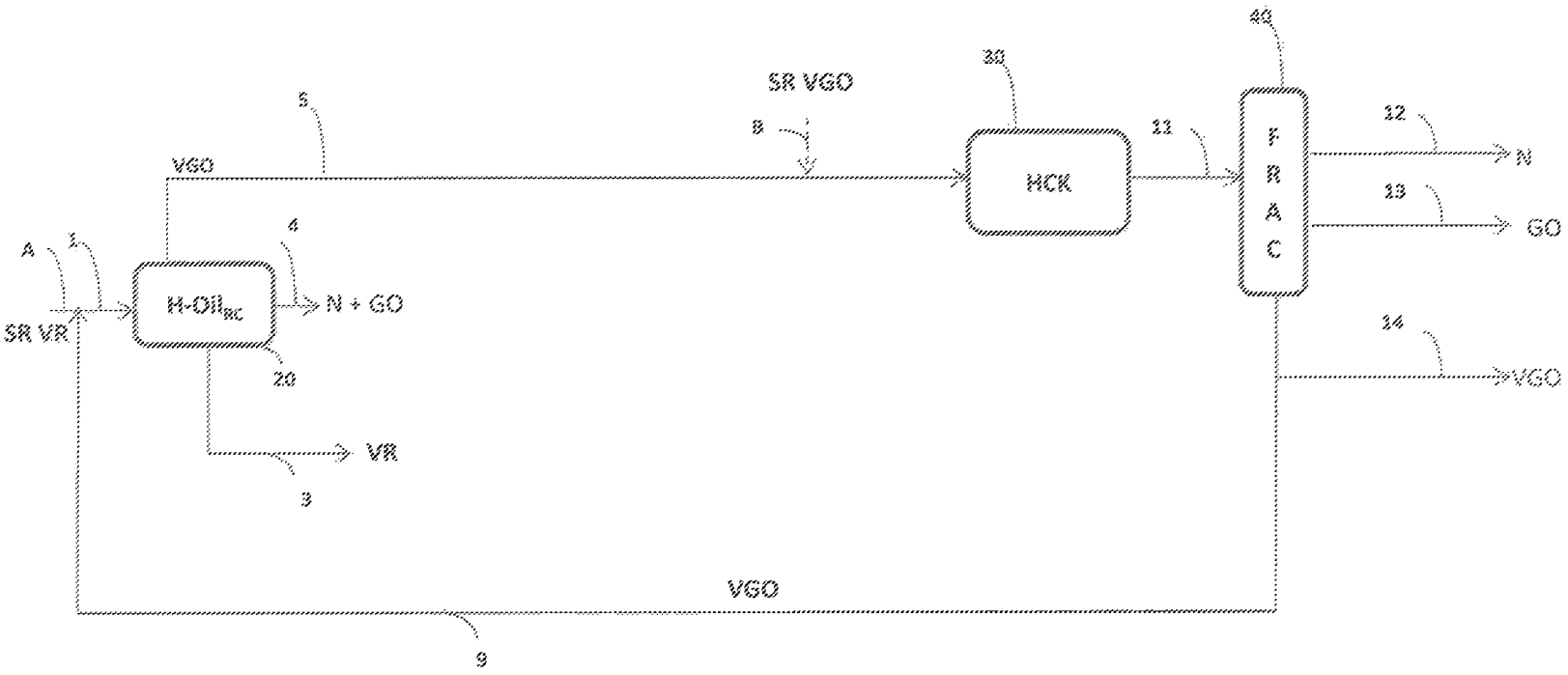
FIGS. 1, 2, 3 and 4 are schematic representations of processes of the present invention.

The process in accordance with the invention comprises at least one first ebullated bed step in accordance with the invention for hydroconverting a feed. This technology is in particular marketed under the name "H-Oil® process".

First Hydroconversion Step

The conditions for the first step for hydroconversion of the feed in the presence of hydrogen are usually conventional conditions for ebullated bed hydroconversion of a liquid hydrocarbon fraction or of coal in suspension in a liquid hydrocarbon phase.

Usually, the operation is carried out under an absolute pressure which is generally in the range 5 to 35 MPa, preferably in the range 10 to 25 MPa, at a temperature of 260° C. to 600° C. and usually 350° C. to 550° C. The hourly space velocity (HSV) and the partial pressure of hydrogen are important factors which are selected as a function of the characteristics of the feed to be treated and the desired conversion. Usually, the HSV is in the range 0.05 $h^{-1}$ to 10 $h^{-1}$, preferably 0.1 $h^{-1}$ to 5 $h^{-1}$.

In accordance with the invention, the weighted average bed temperature of the catalytic bed for the first hydroconversion step is advantageously in the range 260° C. to 600° C., preferably in the range 300° C. to 600° C. and more preferably in the range 350° C. to 550° C.

The quantity of hydrogen mixed with the feed is normally 50 to 5000 normal cubic metres ($Nm^3$) per cubic metre ($m^3$)

of liquid feed. Advantageously, the hydrogen is employed in a volume ratio with the feed in the range 100 to 1000 $m^3/m^3$, preferably in the range 300 to 800 $m^3/m^3$, and more preferably in the range 300 to 600 $m^3/m^3$.

It is possible to use a granular catalyst for the ebullated bed hydroconversion of residues, comprising at least one compound of a metal with a hydrodehydrogenating function on an amorphous support. This catalyst may be a catalyst comprising metals from group VIII, for example nickel and/or cobalt, usually in association with at least one metal from group VIB, for example molybdenum and/or tungsten. As an example, it is possible to use a catalyst comprising 0.5% to 10% by weight of nickel, preferably 1% to 5% by weight of nickel (expressed as the nickel oxide, NiO) and 1% to 30% by weight of molybdenum, preferably 5% to 20% by weight of molybdenum (expressed as molybdenum oxide, $MoO_3$) on an amorphous mineral support. This support is, for example, selected from the group formed by alumina, silica, silica-aluminas, magnesia, clays and mixtures of at least two of these minerals. This support may also include other compounds, for example oxides selected from the group formed by boron oxide, zirconia, titanium oxide, phosphorus pentoxide. Usually, an alumina support is used, more usually an alumina support doped with phosphorus and optionally with boron. The concentration of phosphorus pentoxide, $P_2O_5$, is usually less than 20% by weight and usually less than 10% by weight. This concentration of $P_2O_5$ is usually at least 0.001% by weight. The concentration of boron trioxide, $B_2O_3$, is normally 0 to 10% by weight. The alumina used is usually a gamma or rho alumina. This catalyst is more usually in the form of an extrudate. In all cases, the attrition resistance of the catalyst must be high because of the specific constraints associated with ebullated beds.

The total quantity of oxides of metals from groups VI and VIII is often 5% to 40% by weight, and in general 7% to 30% by weight, and the weight ratio expressed as the metallic oxide between the metal (or metals) from group VI to the metal (or metals) from group VIII (group VI oxide/group VIII oxide by weight) is in general 20 to 1 and usually 10 to 2. The spent catalyst s partially replaced with fresh catalyst by withdrawal from the bottom of the reactor and introducing fresh or new catalyst into the top of the reactor at regular time intervals, i.e. for example, in bursts or quasi-continuously. As an example, it could be possible to introduce fresh catalyst every day. The replacement ratio of spent catalyst to fresh catalyst may, for example, be 0.01 kilogram to 10 kilograms per cubic metre of feed. This withdrawal and replacement are carried out using devices that allow this hydroconversion step to operate continuously. The unit normally comprises a recirculating pump in order to maintain the catalyst in an ebullated bed by continuously recycling at least a portion of the liquid withdrawn from the head of the reactor and reinjecting it into the bottom of the reactor. It is also possible to send the spent catalyst withdrawn from the reactor to a. regeneration zone in which the carbon and sulphur it contains is eliminated, then this regenerated catalyst is returned to the hydroconversion step a). It is also possible to send the spent catalyst to a rejuvenation zone in order to extract a portion of the metals and coke originating from the feed and deposited on the catalyst.

The hydroconverted liquid effluent obtained from the first ebullated bed hydroconversion step (step a) advantageously undergoes a separation step b) in order to produce at least one fraction comprising a gasoline cut and a gas oil cut, a vacuum gas oil fraction and a residual unconverted fraction.

In accordance with the invention, the boiling point of the gasoline fraction (or cut) is advantageously in the range 20° C. to 130° C., preferably in the range 20° C. to 180° C.; the boiling point of the gas oil fraction (or cut) is advantageously in the range 130° C. to 380° C., preferably in the range 180° C. to 350° C.; the boiling point of the vacuum gas oil fraction is advantageously in the range 350° C. to 550° C., preferably in the range 380° C. to 500° C.; the boiling point of the residual unconverted fraction is preferably at least 500° C. or even 550° C.

This separation step is carried out using any means known to the skilled person, in particular by atmospheric fractionation followed by vacuum fractionation.

Hydrocracking Step

In accordance with the invention, at least a portion of the vacuum gas oil (VGO) separated in step b) is treated in a hydrocracking step comprising at least one hydrocracking reactor.

In the context of the present invention, the expression "hydrocracking" encompasses cracking processes comprising at least one step for conversion of the feeds using at least one catalyst in the presence of hydrogen.

Hydrocracking may be operated using one-step layouts comprising, firstly, intense hydrorefining which is intended to carry out intense hydrodenitrogenation and desulphurization of the feed before the effluent is sent in its entirety to the hydrocracking catalyst proper, in particular in the case in which it comprises a zeolite.

It also encompasses two-step hydrocracking, which comprises a first step which, like the "one-step" process, is intended to carry out hydrorefining of the feed, but also to obtain a conversion of this feed which is generally of the order of 30 to 60 percent. In the second step of a two-step hydrocracking process, in general only the fraction of the feed which is not converted during the first step is treated.

The conventional hydrorefining catalysts generally contain at least one amorphous support and at least one hydrodehydrogenating element (generally at least one element from the non-noble groups VIB and VIII, and usually at least one element from group VIB and at least one non-noble element from group VIII).

Examples of the matrices which may be used alone or as a mixture in the hydrorefining catalyst are alumina, halogenated alumina, silica, silica-alumina, clays (selected, for example, from natural clays such as kaolin or bentonite), magnesia, titanium oxide, boron oxide, zirconia, aluminium phosphates, titanium phosphates, zirconium phosphates, coal and aluminates. It is preferable to use matrices containing alumina, in all forms known to the skilled person, and still more preferably aluminas, for example gamma alumina.

The operating conditions for the hydrocracking step are adjusted in a manner such as to maximize the production of the gas oil fraction while ensuring that the hydrocracking unit operates properly. The operating conditions used in the reaction zone or zones are generally a weighted average bed temperature for the catalytic bed (WABT) in the range 300° C. to 550° C., preferably in the range 350° C. to 500° C.

The pressure is generally in the range 5 to 35 MPa, preferably in the range 6 to 25 MPa. The liquid hourly space velocity (flow rate of feed/volume of catalyst) is generally in the range 0.1 to 10 $h^{-1}$, preferably in the range 0.2 to 5 $h^{-1}$.

A quantity of hydrogen is introduced such that the volume ratio, in $m^3$ of hydrogen per $m^3$ of hydrocarbon, at the inlet to the hydrocracking step is in the range 300 to 2000 $m^3/m^3$, usually in the range 500 to 1800 $m^3/m^3$, preferably in the range 600 to 1500 $m^3/m^3$.

This reaction zone generally comprises at least one reactor comprising at least one fixed bed hydrocracking catalyst. The fixed bed of hydrocracking catalyst may optionally be preceded by at least one fixed bed of a hydrorefining catalyst (hydrodesulphurization, hydrodenitrogenation for example). The hydrocracking catalysts used in the hydrocracking processes are generally bi-functional in type, associating an acid function with a hydrogenating function. The acid function may be provided by supports with a large surface area (150 to 800 $m^2/g$ in general) and with a superficial acidity, such as halogenated aluminas (in particular chlorinated or fluorinated), combinations of boron oxide and aluminium, amorphous silica-aluminas known as amorphous hydrocracking catalysts, and zeolites. The hydrogenating function may be provided either by one or more metals from group VIII of the periodic classification of the elements, or by an association of at least one metal from group VIE of the periodic classification and at least one metal from group VIII.

The hydrocracking catalyst may also comprise at least one crystalline acidic function such as a Y zeolite, or an amorphous acid function such as a silica-alumina, at least one matrix and a hydrodehydrogenating function.

Optionally, it may also comprise at least one element selected from boron, phosphorus and silicon, at least one element from group VIIA (chlorine, fluorine for example), at least one element from group VIM (for example manganese), and at least one element from group VB (for example niobium).

Deasphalting Step

In variations, the process of the invention may implement a deasphalting step. The deasphalting step may be carried out on the unconverted residual fraction obtained from separation step b).

One of the aims of the deasphalting step is on the one hand to maximize the quantity of deasphalted oil, and on the other hand to maintain or even minimize the asphaltenes content. This asphaltenes content is generally determined in terms of the quantity of asphaltenes which are insoluble in heptane, i.e. measured using a method described in the AFNOR standard (NF-T 60115) of January 2002.

In accordance with the invention, the quantity of asphaltenes in the deasphalted effluent (also known as DeAsphalted Oil or DAO) is less than 3000 ppm by weight.

Preferably, the asphaltenes content in the deasphalted effluent is less than 1000 ppm by weight, more preferably less than 500 ppm by weight.

Below an asphaltenes content of 500 ppm by weight, the method of AFNOR standard (NF-T 60115) is no longer sufficient to measure this content. The Applicant has developed an analytical method covering the quantitative analysis of asphaltenes from straight run distillation products and the heavy products obtained from residue deasphalting. This method can be used for concentrations of asphaltenes of less than 3000 ppm by weight and more than 50 ppm by weight. The method in question consists of comparing the absorbance at 750 nm of a sample in solution in toluene with that of a sample in solution in heptane after filtration. The difference between the two measured values is correlated to the concentration of insoluble asphaltenes in heptane using a calibration equation. This method is a supplement to the AFNOR (NF-T 60115) method and the standard IP 143 method which are used for higher concentrations.

The solvent used during the deasphalting step is advantageously a paraffinic solvent, a gasoline cut or condensates containing paraffins.

Preferably, the solvent used comprises at least 50% by weight of hydrocarbon compounds containing 3 to 7 carbon atoms, more preferably between 4 and 7 carbon atoms, still more preferably 4 or 5 carbon atoms.

Depending on the solvent used, the yield of deasphalted oil and the quality of this oil may vary. By way of example, when changing from a solvent containing 3 carbon atoms to a solvent containing 7 carbon atoms, the oil yield increases but, in contrast, the quantities of impurities (asphaltenes, metals, Conradson Carbon, sulphur, nitrogen, etc.) also increases.

Furthermore, for a given solvent, the choice of operating conditions, in particular the temperature and the quantity of solvent injected, has an impact on the yield of deasphalted oil and on the quality of this oil. The skilled person is able to select the optimal conditions for obtaining an asphaltenes content of less than 3000 ppm.

The deasphalting step may be carried out using any means known to the skilled person. This step is generally carried out in a mixer settler or in an extraction column. Preferably, the deasphalting step is carried out in an extraction column.

In accordance with a preferred embodiment, a mixture comprising the hydrocarbon feed and a first fraction of a solvent feed is introduced into the extraction column, the volume ratio between the solvent fraction feed and the hydrocarbon feed being termed the solvent ratio injected with the feed. This step is intended to properly mix the feed with the solvent entering the extraction column. In the settling zone at the bottom of the extractor, it is possible to introduce a second fraction of the solvent feed, the volume ratio between the second solvent feed fraction and the hydrocarbon feed being termed the solvent ratio injected into the bottom of the extractor. The volume of the hydrocarbon feed considered in the settling zone is generally that introduced into the extraction column. The sum of the two volume ratios between each of the solvent feed fractions and the hydrocarbon feed is termed the overall solvent ratio. Settling the asphalt consists of washing the emulsion of asphalt in the solvent+oil mixture with pure solvent using a counter-current. It is generally favoured by an increase of the solvent ratio (in fact by replacing the solvent+oil environment with a pure solvent environment) and increasing the temperature.

The overall solvent ratio with respect to the treated feed is preferably in the range 2.5/1 to 20/1, more preferably in the range 3/1 to 12/1, more preferably in the range 4/1 to 10/1.

This overall solvent ratio can be broken down into a solvent ratio injected with the feed at the head of the extractor, preferably in the range 0.5 to 5/1, preferably in the range 1/1 to 5/1 and a solvent ratio injected into the bottom of the extractor, preferably in the range 2/1 to 15/1, more preferably in the range 3/1 to 10/1.

Furthermore, in a preferred embodiment, a temperature gradient is established between the head and the bottom of the column which enables an internal reflux to be generated, which improves separation between the oily medium and the resins. In fact, the solvent+oil mixture heated at the head of the extractor can be used to precipitate a fraction comprising the resin which descends into the extractor. The rising counter-current of the mixture can be used to dissolve the fractions comprising the resin which are the lightest at a lower temperature.

In the deasphalting step, the typical temperature at the head of the extractor varies depending on the selected solvent and is generally in the range 60° C. to 220° C., preferably in the range 70° C. to 210° C., and the temperature at the bottom of the extractor is preferably in the range 50° C. to 190° C., more preferably in the range 60° C. to 180° C.

The prevailing pressure in the interior of the extractor is generally adjusted in a manner such that all of the products remain in the liquid state. This pressure is preferably in the range 4 to 5 MPa.

Second Hydroconversion Step

The invention may also comprise a second hydroconversion step. This second hydroconversion step of the invention may be carried out in a fixed bed in accordance with the invention, or in an ebullated bed.

This second hydroconversion step is generally carried out on a deasphalted hydrocarbon cut obtained from the deasphalting step when this is carried out in the process of the invention.

The conditions for the second step for hydroconversion of the feed in the presence of hydrogen are usually an absolute pressure which is generally in the range 5 to 35 MPa, preferably in the range 10 to 25 MPa, a temperature of 260° C. to 600° C. and usually 350° C. to 550° C. The hourly space velocity (HSV) and the partial pressure of hydrogen are important factors which are selected as a function of the characteristics of the product to be treated and the desired conversion. Usually, the HSV is in the range $0.1^{-1}$ to $10\ h^{-1}$, preferably $0.15\ h^{-1}$ to $5\ h^{-1}$.

In accordance with the invention, the weighted average bed temperature of the catalytic bed for the second hydroconversion step is advantageously in the range 260° C. to 600° C., preferably in the range 300° C. to 600° C., more preferably in the range 350° C. to 550° C.

The quantity of hydrogen mixed with the feed is usually 50 to 5000 normal cubic metres ($Nm^3$) per cubic metre ($m^3$) of liquid feed. Advantageously, the hydrogen is used in a ratio by volume with the feed in the range 300 to 2000 $m^3/m^3$, preferably in the range 500 to 1800 $m^3/m^3$, and more preferably in the range 600 to 1500 $m^3/m^3$.

It is possible to use a conventional granular hydroconversion catalyst comprising at least one compound of a metal with a hydrodehydrogenating function on an amorphous support. This catalyst may be a catalyst comprising metals from group VIII, for example nickel and/or cobalt, usually in association with at least one metal from group VIB, for example molybdenum and/or tungsten. As an example, it is possible to use a catalyst comprising 0.5% to 10% by weight of nickel, preferably 1% to 5% by weight of nickel (expressed as the nickel oxide, NiO) and 1% to 30% by weight of molybdenum, preferably 5% to 20% by weight of molybdenum (expressed as molybdenum oxide, $MoO_3$) on an amorphous mineral support. This support is, for example, selected from the group formed by alumina, silica, silica-aluminas, magnesia, clays and mixtures of at least two of these minerals. This support may also include other compounds, for example oxides selected from the group formed by boron oxide, zirconia, titanium oxide, phosphorus pentoxide. Usually, an alumina support is used and more usually, an alumina support doped with phosphorus and optionally with boron is used. The concentration of phosphorus pentoxide, $P_2O_5$, is usually less than 20% by weight and usually less than 10% by weight. This concentration of $P_2O_5$ is usually at least 0.001% by weight. The concentration of boron trioxide, $B_2O_3$, is normally 0 to 10% by weight. The alumina used is usually a gamma or rho alumina. This catalyst is more usually in the form of an extrudate.

The total quantity of oxides of metals from groups VI and VIII is often 5% to 40% by weight, and in general 7% to 30% by weight and the weight ratio, expressed as the metallic oxide, between the metal (or metals) from group VI and the metal (or metals) from group VIII (group VI oxide/group VIII oxide by weight) is in general 20 to 1 and usually 10 to 2. The spent catalyst is partially replaced with fresh catalyst by withdrawal from the bottom of the reactor and introducing fresh or new catalyst into the top of the reactor for a regular time intervals, i.e. for example, in bursts or quasi-continuously. As an example, it could be possible to introduce fresh catalyst every day. The replacement ratio of spent catalyst to fresh catalyst may, for example, be 0.01 kilogram to 10 kilograms per cubic metre of feed. This withdrawal and replacement are carried out using devices that allow this hydroconversion step to operate continuously. The unit normally comprises a recirculating pump in order to maintain the catalyst in an ebullated bed by continuously recycling at least a portion of the liquid withdrawn from the head of the reactor and reinjecting it into the bottom of the reactor. It is also possible to send the spent catalyst withdrawn from the reactor to a regeneration zone in which he carbon and sulphur it contains is eliminated, then to send this regenerated catalyst to the second hydroconversion step. It is also possible to send the spent catalyst obtained from this step as a makeup of catalyst for the upstream ebullated bed vacuum residue hydroconversion unit.

The effluent obtained from the second hydroconversion step advantageously undergoes a separation step f) in order to produce at least one fraction comprising a gasoline cut and a gas oil cut, a vacuum gas oil fraction and a residual unconverted fraction.

This separation step f) is carried out using any means known to the skilled person, for example by distillation.

First Variation of the Process of the Invention

In a first variation of the process of the invention known as the "1D implementation", the feed for the process of the invention is treated in a first hydroconversion step (step a), for example of the H-Oil type, and the effluent obtained is separated (step b) into at least one fraction comprising a gasoline cut (also termed naphtha) and a gas oil cut, a vacuum gas oil fraction and a residual unconverted fraction. The vacuum gas oil fraction obtained thereby is sent to the hydrocracking step c), optionally with a straight run gas oil fraction.

In accordance with this first variation of the process of the invention, the effluent obtained from the hydrocracking step is fractionated in the fractionation step e) into several fractions including a gasoline fraction, a gas oil fraction and an unconverted vacuum gas oil fraction. The fractionation step is carried out using any means known to the skilled person, for example distillation.

All or a portion of the unconverted vacuum gas oil fraction obtained from fractionation step e) is recycled to the first hydroconversion step.

Thus, referring to FIG. 1, the feed A constituted by a vacuum residue (SR VR) is sent via the conduit 1 to a hydroconversion section 20 (denoted H-Oil$_{RC}$ in FIG. 1) in order to produce, after separation (not shown), a fraction 4 comprising a gasoline cut (N) and a gas oil cut (GO), a vacuum gas oil fraction 5 (VGO) and a residual unconverted fraction 3 (VR). The vacuum gas oil fraction (VGO) is then sent to a hydrocracking section 30 via the conduit 5. This fraction could be sent to the section 30 (HCK) as a mixture with the distilled vacuum gas oil fraction B (SR VGO). The effluent obtained from the hydrocracking section is then separated in the fractionation zone 40 (denoted FRAC in FIG. 1), into a gasoline fraction 12 (N), a gas oil fraction 13 (GO) and a vacuum gas oil fraction 14, (VGO). In order to maximize the gas oil fraction yield, at least a portion of the VGO is returned to the first hydroconversion section 20 via the conduit 9. This VGO is partially cracked in the hydroconversion section and the unconverted VGO is in turn partially converted in the hydrocracking section 30. Thus, compared with the prior art layout represented in FIG. 0 and for which the legend is identical to that of FIG. 1, the yield of VGO 14 from the process can change from 5% by weight to less than 1% by weight, to the gain of an additional co-production of gas oil fraction 13 with high added value.

Second Variation of the Process of the Invention

A second variation of the process of the invention, termed "2D implementation" employs a deasphalting step.

This variation is distinguished from the 1D variation in that at least a portion of the residual unconverted fraction obtained from step b) may be sent to a deasphalting step in which it is treated in an extraction section using a solvent under conditions that mean that a deasphalted hydrocarbon cut and residual asphalt (pitch) can be obtained.

This operation can be used to extract a large portion of the asphaltenes and to reduce the quantity of metals in the unconverted residual fraction. During this deasphalting step, these latter elements become concentrated in an effluent termed the asphalt or pitch.

The deasphalted effluent, often known as deasphalted oil, abbreviated to DAO, has a reduced asphaltenes and metals content.

In accordance with this variation of the "2D implementation" process, the deasphalted hydrocarbon cut obtained from the deasphalting step is sent to the hydrocracking step c) as a mixture with the vacuum gas oil fraction obtained from step b) and optionally with a straight run vacuum gas oil fraction.

The hydrocracking effluent is then fractionated in the fractionation zone into a plurality of fractions including a gasoline fraction, a gas oil fraction and an unconverted vacuum gas oil fraction. At least a portion of the vacuum gas oil fraction obtained from fractionation step e) is recycled to the inlet to the deasphalting step and/or to the inlet to the first hydroconversion step.

Figure 2:
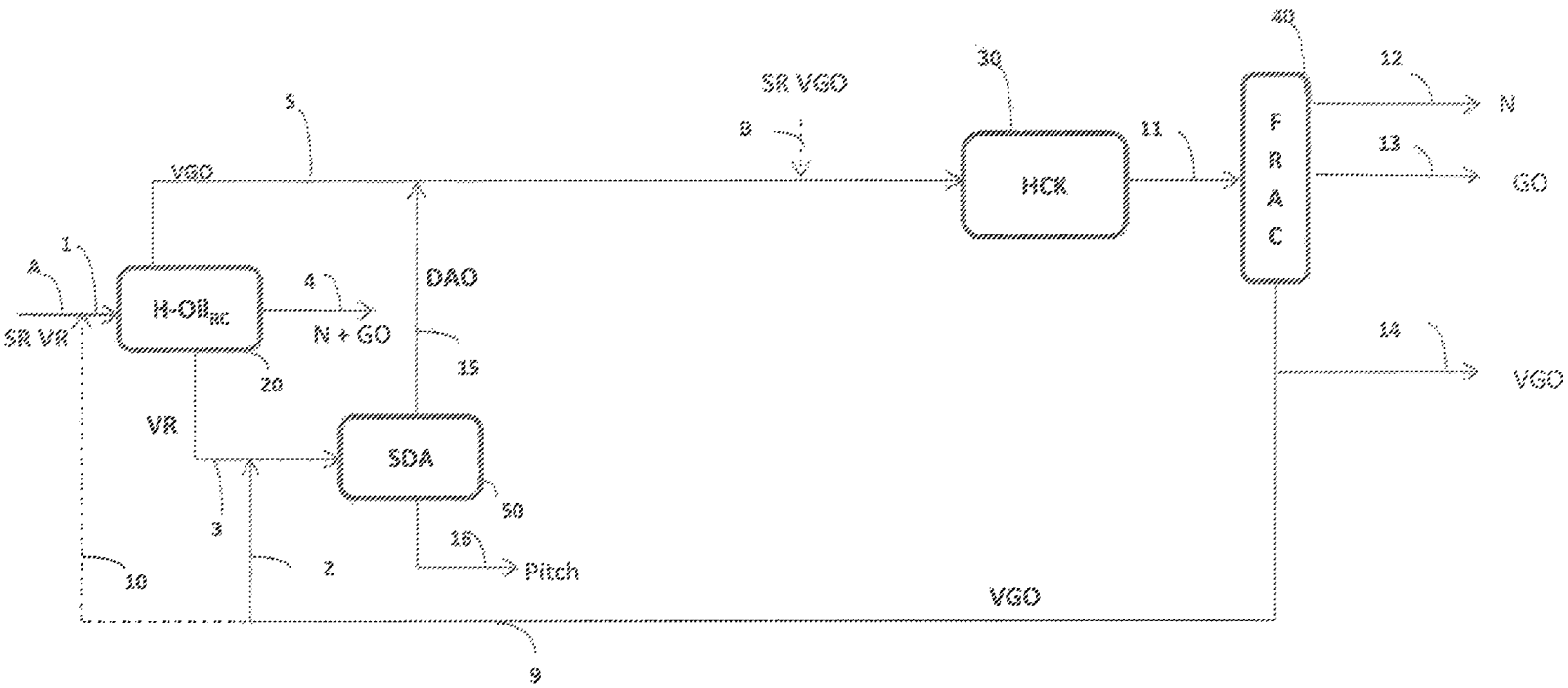

Thus, referring to FIG. 2, the feed A constituted by a vacuum residue (SR VR) is sent via the conduit 1 to a hydroconversion section 20 (denoted H-Oil$_{RC}$ in FIG. 2) in order to produce, after separation (not shown), a fraction 4 comprising a gasoline cut (N) and a gas oil cut (GO), a vacuum gas oil fraction 5 (VGO) and a residual unconverted fraction 3 (VR). The vacuum gas oil fraction is sent to the hydroconversion section 30 via the conduit 5. The residual unconverted fraction (VR) is sent to a deasphalting unit 50 (SDA) via the conduit 3 in order to extract a deasphalted oil (DAO) and a residual asphalt (pitch). The deasphalted oil fraction (DAO) is then sent to a hydrocracking section (HCK) 30 via the conduit 15. The effluent from the hydrocracking section is then separated in the fractionation zone 40 into a gasoline fraction 12 (N), a gas oil fraction 13 (GO) and a vacuum gas oil fraction 14, (VGO). In order to maximize the gas oil fraction yield, at least a portion of the VGO is returned to the deasphalting unit 50 (SDA) via conduits 9 and 2. A portion of this VGO may be sent to the first hydroconversion section 30 via the conduit 10.

Third Variation of the Process of the Invention

The third variation of the process of the invention, known as the "3D implementation", is distinguished from the second variation by the fact that the deasphalted hydrocarbon cut obtained from the deasphalting step is sent to a second step for hydroconversion in the presence of hydrogen under conditions allowing, preferably after a separation step f), production of a fraction comprising a gasoline cut and a gas oil cut, a vacuum gas oil fraction (VGO) and a residual unconverted fraction. This second hydroconversion step may be carried out under fixed bed hydrocracking conditions in accordance with the invention or under ebullated bed hydrocracking conditions.

In this variation, the vacuum gas oil fraction obtained from separation step f) is sent to the hydroconversion step c) as a mixture with the vacuum gas oil fraction obtained from step b) and optionally with a straight run vacuum gas oil fraction.

In this variation of the process, the hydroconversion effluent is fractionated in the fractionation zone (step e) into several fractions including a gasoline fraction, a gas oil fraction and an unconverted vacuum gas oil fraction.

In this variation of the invention known as the "3D implementation", at least a portion of the vacuum gas oil fraction obtained from fractionation step e) is recycled to the inlet to the deasphalting step and/or to the inlet to the first hydroconversion step.

Figure 3:
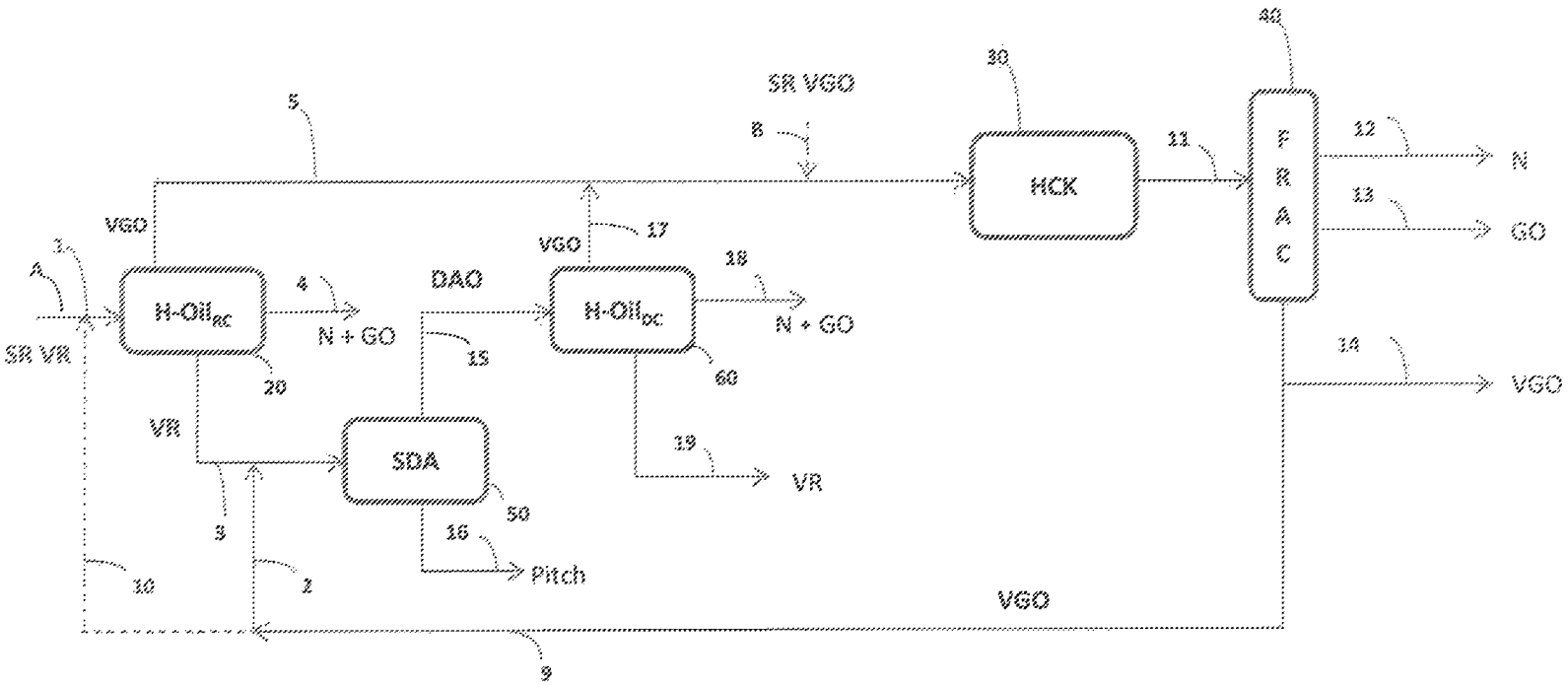
Figure 4:
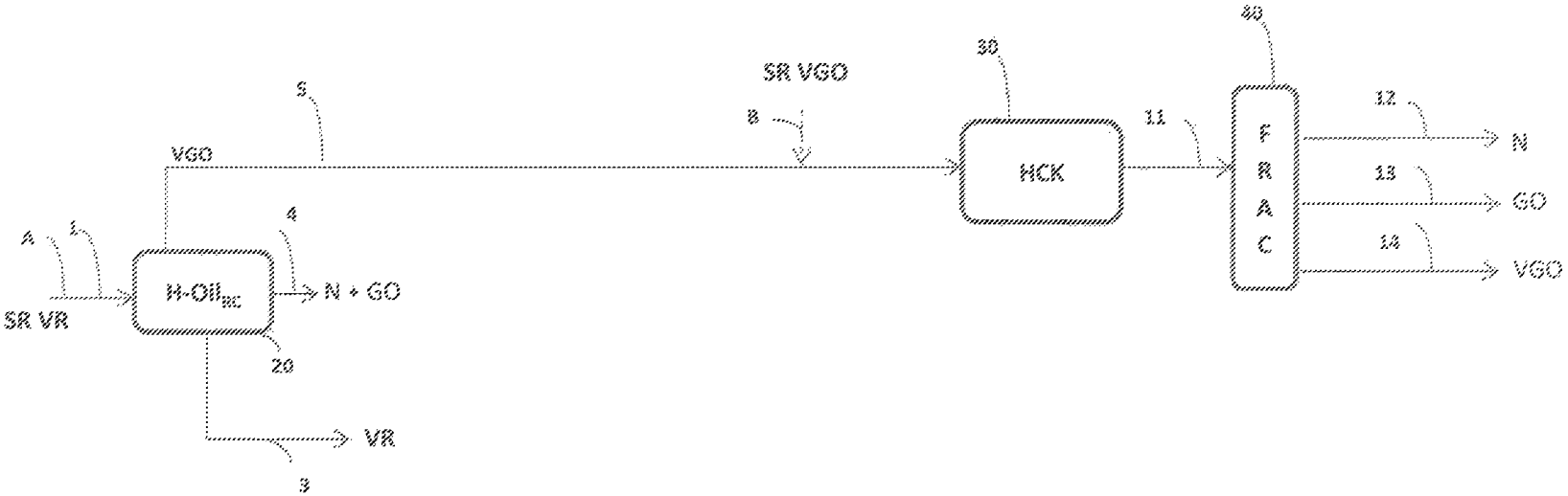

Thus, referring to FIG. 3, the feed A constituted by vacuum residues (SR VR) is sent via the conduit 1 to a hydroconversion section 20 (denoted H-Oil$_{RC}$ in FIG. 3) in order to produce, after separation (not shown), a fraction 4 comprising a gasoline cut (N) and a gas oil cut (GO), a vacuum gas oil fraction 5 (VGO) and a residual unconverted fraction 3 (VR). The vacuum gas oil fraction is sent to the hydrocracking section (HCK) 30 via the conduit 5. The residual unconverted fraction (VR) is sent via the conduit 3 to a deasphalting unit 50 (SDA) in order to extract a deasphalted oil (DAO) and a residual asphalt (Pitch). The deasphalted oil fraction (DAO) is then sent to a hydroconversion section 60 (denoted H-Oil$_{DC}$ in FIG. 3) in order to produce a fraction 18 comprising a gasoline cut (N) and a gas oil cut (GO) and a vacuum gas oil fraction 17 (VGO) and a residual unconverted fraction 19 (VR). The vacuum gas oil fraction 17 obtained from section 60 is then sent to the hydrocracking section 30 via the conduit 5. The effluent from the hydrocracking section is then separated, in the fractionation zone 40, into a gasoline fraction 12 (N), a gas oil fraction 13 (GO) and a vacuum gas oil fraction 14, (VGO). In order to maximize the gas oil fraction yield, at least a portion of the VGO is returned to the deasphalting unit 50 (SDA) via conduits 9 and 2. A portion of this VGO may be sent to the first hydroconversion section 30 via the conduit 10.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding application No. FR 1462715, filed Dec. 18, 2014, are incorporated by reference herein.

Examples

The feed used in these examples had the composition detailed in Table 1. It was an "Arabian Heavy" type residue, i.e. a vacuum residue obtained by distillation of a crude oil originating from the Arab Peninsula.

TABLE 1

Composition of the feed used ("Arabian Heavy" vacuum residue)

| Property | Unit | Value |
|---|---|---|
| Density | — | 1.040 |
| Viscosity at 100° C. | cSt | 5200 |
| Conradson Carbon | % by wt | 23.5 |
| C7 asphaltenes | % by wt | 13.8 |
| Nickel | ppm | 52 |
| Vanadium | ppm | 140 |
| Nitrogen | ppm | 5300 |
| Sulphur | % by wt | 5.4 |
| 565° C.⁻ cut* | % by wt | 16.45 |

*cut containing products with a boiling point of less than 565° C.

This feed was used in the various variations of the process illustrated by layouts 0, 1D, 2D, 3D (respectively represented in FIGS. 0, 1, 2 and 3) without the addition of straight run vacuum gas oil (SR VGO) to the inlet to the hydrocracking step (HCK). Furthermore, regarding the layouts 2D and 3D, the recycle of VGO obtained from fractionation was sent only to the deasphalting unit (SDA), while in the case of layout 1D it was sent to the first hydroconversion unit H-Oil$_{RC}$.

The operating conditions for the conversion sections H-Oil$_{RC}$, H-Oil$_{DC}$, first and second hydroconversion unit, HCK (hydrocracking unit) as well as the solvent deasphalting unit (SDA) are summarized in Table 2.

The H-Oil hydroconversion units were operated with ebullated bed reactors and the hydroconversion unit was operated with a fixed bed reactor.

The deasphalting unit was operated with an extraction column.

TABLE 2

Operating conditions for units

| parameter | | H-Oil$_{RC}$ | H-Oil$_{DC}$ | HCK | SDA |
|---|---|---|---|---|---|
| Liquid HSV | $h^{-1}$ | 0.25 | 0.3 | 0.25 | — |
| Pressure | MPa | 18 | 17 | 18 | 4.5 |
| WABT SOR* | ° C. | 420 | 445 | 385 | — |
| Extractor temperature | | | | | 120 at head of extractor 90 at extractor bottom |
| $H_2$/feed | $m^3/m^3$ | 400 | 300 | 1000 | — |
| Solvent/feed | $m^3/m^3$ | — | — | — | 2/1 |
| Extractor inlet | | | | | |
| Extract bottom | $m^3/m^3$ | | | | 4/1 |
| Catalysts | | HOC 458 ™ | HTS 458 ™ | HRK 1448 ™ HYK 732 ™ | — |
| Catalyst compositions | | NiMo/$Al_2O_3$ | NiMo/$Al_2O_3$ | NiMo/$Al_2O_3$ NiMo/Y zeolite | |

*Weighted Average Bed Temperature at Start of Run

The catalysts used were commercial catalysts from Axens. The solvent used in the SDA unit was a mixture of butanes comprising 60% of nC4 and 40% of iC4.

The yields and products obtained are indicated in Table 3 as a percentage by weight of each product obtained with respect to the initial weight of the vacuum residue feed (SR VR) introduced into the process.

TABLE 3

Yields of products as a function of the process layout used

| % by wt vs. SR VR* | FIG. 0 (prior art) | Variation 1D (Invention) | Variation 2D (invention) | Variation 3D (invention) |
|---|---|---|---|---|
| LN | 8 | 8 | 9 | 9 |
| HN | 9 | 10 | 12 | 12 |
| GO | 47 | 50 | 55 | 57 |
| VGO | 5 | <1 | 4 | <1 |
| VR + pitch | 22 | 22 | 10 | 11 |
| Total liquids | 91 | 91 | 90 | 90 |

*LN: Light Naphta, HN: Heavy Naphta, GO: Gas Oil VGO: Vacuum Gas Oil, VR: Vacuum Residue, SR Straight Run.

Table 4 indicates the properties of the various products obtained using the various layouts of the process.

It appears that the gas oil yield (GO) increased respectively by 6.5%, 17% and 21% for the implemented layouts 1D, 2D and 3D compared with the prior art layout (layout 0) for a constant liquid yield (90% or 91%). The 2D implementation layout could also be used to co-produce a little vacuum gas oil (VGO). The 3D layout performed better in terms of gas oil yield with a negligible production of VGO.

TABLE 4

Properties of products obtained from hydrocracking

| | | LN | HN | GO |
|---|---|---|---|---|
| Cut points | ° C. | 30-80 | 80-150 | 150-370 |
| Density | — | 0.685 | 0.755 | 0.825 |
| Sulphur | ppm | <1 | <1 | <10 |
| P/N/A* | % by wt | 63/36/1 | 31/66/3 | |
| Cetane | — | — | — | 47 |

*Paraffins/Naphthenes/Aromatics

Table 4 shows that the gas oil obtained from the hydrocracking steps complied with Euro V specifications apart from cetane. The cetane deficit (cetane motor number measured in accordance with ASTM standard D 613, may be made up either by using additives, or by mixing with other gas oil cuts with a higher cetane index.

The naphthas obtained from the hydrocracking step may be upgraded as they are, for example in catalytic reforming units in order to produce gasoline.

The distillates obtained from the H-Oil hydroconversion units (naphtha and GO in the 1D, 2D or 3D layouts) necessitate hydrotreatment steps in order to obtain products complying with commercial specifications.

The vacuum residues (VR obtained from the H-Oil$_{RC}$ unit, VR obtained from the H-Oil$_{DC}$ unit and asphalt obtained from deasphalting) were principally upgraded as heavy fuel after adjusting their viscosity by mixing with distillates available on site.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for the intense conversion of a heavy hydrocarbon feed, comprising the following steps:

a) a first step for ebullated bed hydroconversion of the feed in the presence of hydrogen, comprising at least one three-phase reactor containing at least one ebullated bed hydroconversion catalyst;

b) a step for separating at least a portion of a hydroconverted liquid effluent obtained from step a) into a fraction comprising a gasoline cut and a gas oil cut, a vacuum gas oil fraction and an unconverted residual fraction;

c) a step for hydrocracking at least a portion of the vacuum gas oil fraction obtained from step b) in a reactor comprising at least one fixed bed hydrocracking catalyst;

d) a step for fractionating at least a portion of an effluent obtained from step c) into a gasoline fraction, a gas oil fraction and an unconverted vacuum gas oil fraction;

e) a step for recycling at least a portion of the unconverted vacuum gas oil fraction obtained from step d) to said first hydroconversion step a)

wherein at least a portion of the unconverted residual fraction obtained from step b) is sent to a deasphalting section where it is treated in an extraction step using a solvent under conditions for obtaining a deasphalted hydrocarbon cut and pitch;

wherein said deasphalted hydrocarbon cut is sent to a second hydroconversion step in the presence of hydrogen and at least one ebullated bed hydroconversion catalyst, wherein the effluent obtained from the second hydroconversion step undergoes a separation step f) in order to produce at least one fraction comprising a gasoline cut and a gas oil cut, a vacuum gas oil fraction and a unconverted residual fraction, and wherein the vacuum gas oil fraction obtained from the separation step f) is sent to the hydrocracking step c) as a mixture with the vacuum gas oil fraction obtained from step b) and optionally with a straight run vacuum gas oil fraction.

2. The process according to claim 1, in which at least a portion of the deasphalted hydrocarbon cut is sent to the hydrocracking step c) as a mixture with the vacuum gas oil fraction separated in step b) and optionally with a straight run vacuum gas oil fraction.

3. The process according to claim 1, in which at least a portion of the vacuum gas oil fraction obtained from the fractionation step d) is recycled to an inlet of the deasphalting section.

4. The process according to claim 1, in which the hydroconversion step a) is operated under an absolute pressure in the range 5 to 35 MPa, at a temperature of 260° C. to 600° C. and at an hourly space velocity of 0.05 $h^{-1}$ to 10 $h^{-1}$.

5. The process according to claim 1, in which the hydrocracking step c) is operated at an average bed temperature of the catalytic bed in the range 300° C. to 550° C., a pressure in the range 5 to 35 MPa and a liquid hourly space velocity in the range 0.1 to 10$h^{-1}$.

6. The process according to claim 1, in which in the deasphalting section, the typical temperature at the head of an extractor is in the range 60° C. to 220° C. and the temperature at the bottom of the extractor is in the range 50° C. to 190° C.

7. The process according to claim 1, in which the feed is selected from heavy hydrocarbon feeds of the atmospheric residue or vacuum residue type distillate type feeds, asphalts obtained from oil residue solvent deasphalting, coal in suspension in a hydrocarbon fraction.

8. The process according to claim 7, wherein the vacuum residue type is obtained by straight run oil cut distillation or by vacuum distillation of crude oil, the distillate type feeds are vacuum gas oils or deasphalted oils and the hydrocarbon fraction is gas oil obtained by vacuum distillation of crude oil or a distillate obtained from the liquefaction of coal used alone or as a mixture.

* * * * *